United States Patent [19]

Dutton et al.

[11] 3,979,940

[45] Sept. 14, 1976

[54] WIRE DRAWING MACHINERY

[75] Inventors: David Dutton, Warrington; James Moss, Liverpool, both of England

[73] Assignee: British Insulated Callender's Cables Limited, London, England

[22] Filed: Oct. 30, 1974

[21] Appl. No.: 519,287

Related U.S. Application Data

[63] Continuation-in-part of Ser. No. 407,049, Oct. 17, 1973, abandoned.

[30] Foreign Application Priority Data

Oct. 19, 1972 United Kingdom ..... 48281/72

[52] U.S. Cl. ..... 72/279; 72/281; 72/288; 72/289

[51] Int. Cl.[2] ..... B21C 1/04; B21C 1/12

[58] Field of Search ..... 72/278, 279, 280, 281, 72/288, 289, 443

[56] References Cited

UNITED STATES PATENTS

| | | | |
|---|---|---|---|
| 643,584 | 2/1900 | Baldwin | 72/289 |
| 805,265 | 11/1905 | Cowles et al. | 72/289 |
| 2,708,024 | 5/1955 | Bryden | 72/279 |
| 3,779,055 | 12/1973 | Goyffon | 72/46 |
| 3,810,380 | 5/1974 | Newberry et al. | 72/289 |
| 3,811,312 | 5/1974 | Pietroni | 72/289 |
| 3,842,643 | 10/1974 | Large et al. | 72/289 |

*Primary Examiner*—C.W. Lanham
*Assistant Examiner*—E. M. Combs
*Attorney, Agent, or Firm*—Buell, Blenko & Ziesenheim

[57] ABSTRACT

In a machine for reducing the cross-section of a number of wires by drawing each of them through a respective series of dies of decreasing diameter, a corresponding series of individual capstans is used for drawing each wire through its series of dies, and each one of several drive shafts supports at spaced positions along its length the capstans of a respective drawing stage of each series. Each capstan is driven by the shaft on which it is mounted, and the drive mechanism for the shafts can be adjusted, by presetting or otherwise, to give different peripheral speed ratios to the capstans, to suit different die sets and/or to compensate for wear. The capstans are mounted between bearings supporting the shafts, and the drive mechanism is located outside the bearing at the relevant end of the shaft. Preferably mechanism coupling adjacent shafts alternates between the two ends of the machine.

3 Claims, 8 Drawing Figures

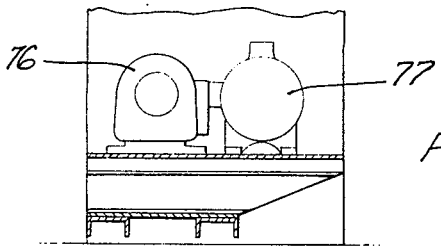
Fig. 6.
Fig. 7.
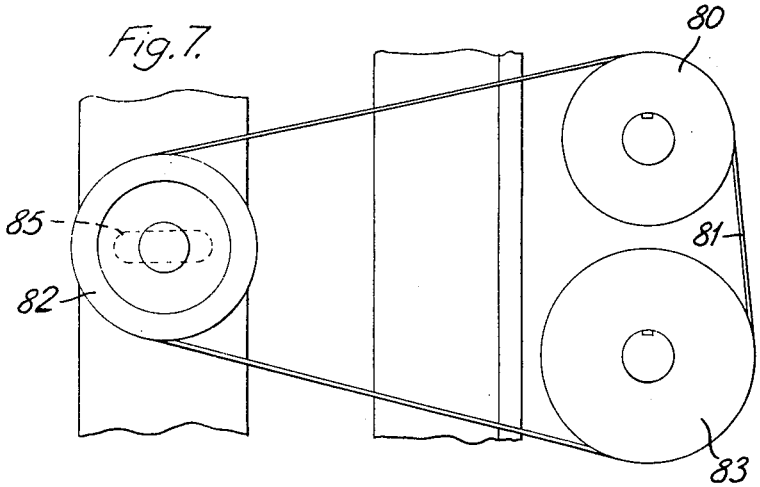
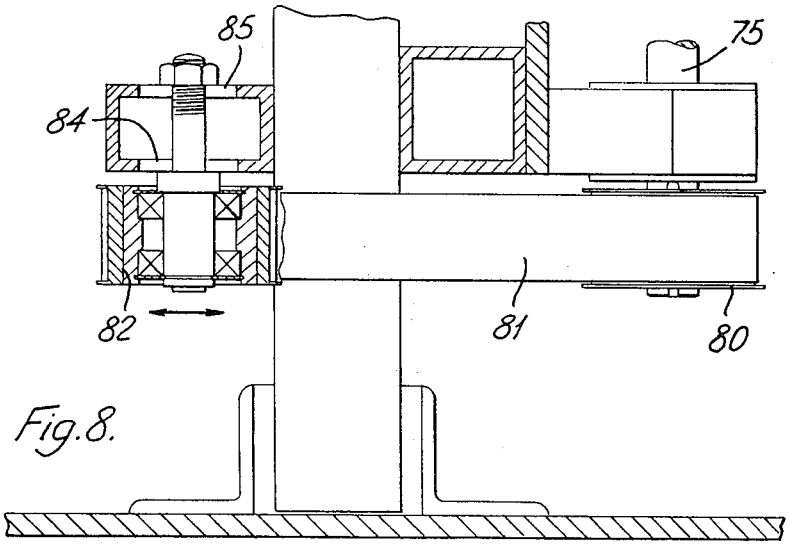
Fig. 8.

WIRE DRAWING MACHINERY

This application is a continuation in part of our application Ser. No. 407049 filed 17th Oct. 1973, now abandoned.

This invention relates to machinery for reducing the cross-section of a number of wires by drawing each of them in a single pass through a series of dies of decreasing diameter. The invention is applicable to the drawing of any metal wire that is sufficiently ductile to be drawn in this way, including gold and silver wires for the jewellery industry, steel wires for various purposes, and alloy resistance wires, but its main application is in drawing copper and aluminium wires, mainly for the electrical industry, and it has special advantages in connection with the drawing of wire for enamelling to form film coated magnet wire (also known as enamelled wire).

In conventional wire-drawing machinery, each drawing die has associated with it a rotatable traction device, hereinafter called a "capstan", having a working surface about which the wire is wrapped, the rotation of the capstan applying to the wire the tension necessary to draw the wire through the die. At each passage through a drawing die, the wire is elongated in proportion to the reduction in its cross-sectional area, and so the peripheral speed of the successive capstans must increase correspondingly (not strictly proportionately, because some slip is often allowed between capstan and wire). Usually, but not invariably, the percentage reduction in cross-sectional area should be at least approximately the same for each drawing stage, and so the predetermined peripheral speed ratio between any particular capstan and the next succeeding capstan (known as the "capstan elongation" of the relevant drawing stage) will usually be constant for all the drawing stages.

A common way of obtaining a predetermined capstan elongation is to assemble alternate capstans into a rigid stepped "cone" supported on a single shaft, but in some cases separate capstans on individual shafts appropriately geared together have been preferred.

The use of cones is inconvenient, because they are inevitably considerably larger in diameter than individual capstans would need to be and also of considerable length and because the close proximity of the wires engaging adjacent steps of cones makes threading-up difficult and in some cases dangerous. These difficulties are avoided if separate capstans on individual shafts are used, but the cost of the machine is greatly increased in view of the individual bearings required if this construction is adopted.

Proposals were made early in the present century to mount a number of wire-drawing capstans on each of a series of common drive shafts, one shaft for each wire-drawing stage, so that the machine would draw several wires simultaneously. We do not know whether such machines were used in the United States or anywhere else, but if so they have long since fallen into disuse.

The present invention is concerned with a machine for reducing the cross-section of a number of wires by drawing each of them through a respective series of dies of decreasing diameter comprising a corresponding series of individual capstans for drawing each wire through its series of dies and a plurality of drive shafts each supporting at spaced positions along its length of capstans for one drawing stage of each of the said series, each capstan being driven by the shaft on which it is mounted.

In most cases the capstans for all the drawing stages should be shaft-mounted, but mounting of some capstans in individual bearings is not excluded and may be advantageous in some circumstances (e.g. to permit production of two wire sizes only slightly different from one another using the same starting size and the same reductions on each die except the last, individual mountings may be used for the last-stage capstans).

Even in a machine of only two wire lines, mounting the capstans of each stage individually on a common shaft has some advantage because compared with cone machines it provides better access and reduced bulk and compared with individually mounted capstans it avoids the need for expensive cantilever bearings (though in this limiting case the overall number of bearings is the same). Significant economies are obtained however with large numbers of lines, preferably at least four; and other economic factors make it desirable that each wire line should include at least four drawing stages.

Where the number of wire lines is large, it may be desirable to insert additional support bearings for the shafts between certain of the drawing capstans. For example, in an 18-line machine each shaft may be supported at its midpoint as well as its ends. When this is done, it may be advisable to use pairs of bearings with a flexible coupling between them, in order to avoid problems in ensuring alignment.

It is normally preferable for the drive shafts to be parallel to one another and to be coplanar; further, especially when designed for use in-line with enamelling apparatus, it is preferable that the shafts should be mounted with their axes horizontal and in the same vertical plane, so that access for threading is from one vertical face (the "front") of the machine.

Preferably the shafts are driven, except possibly for the last shaft, from a common power source (e.g. an electric motor) through gearing (for example, an appropriate chain of gears or drive belts) arranged compactly adjacent to one or both of the ends of the shafts.

The capstans may each have tapered working surfaces, an appropriate taper (for most sizes of copper and aluminium wire) being in the range 0.5°–5°.

In accordance with our invention, a machine of the kind described is improved by providing a drive mechanism for the shafts that will drive the shafts in two or more different speed ratios, so as to provide different capstan elongations.

The drive mechanism may be a pre-set one, for example relying on the substitution of a pair of gear-wheels or of one or both of a pair of belt-engaging wheels, or it may be a continuously-variable mechanism such as can be obtained by a variable-speed gear box or a variable-speed motor. In an especially preferred machine, the shaft carrying the capstans of the last drawing stage has a continuously-variable speed drive, and the remaining shafts are drive by pre-set gearing. Suitably pre-set gearing provides capstan elongations of 11, 15, 20 and 25%.

The present invention allows a large number of wire-drawing lines to be operated in a comparatively small space from a single power source and under the supervision of a single operative, with considerable versatility in drawing different wire sizes and different materials as required, and at a substantially lower capital cost than an aggregation of conventional drawing machines.

This makes it feasible to use an extremely low drawing speed, even when operated purely as a drawing machine (without in-line enamelling etc.) to obtain the benefits of drawing at a speed so low in relation to the reduction at each die that the wire is not heated in its passage through the die to the extent that the metallurgical properties of the drawn wire would be affected by the temperature rise. These advantages are that (i) the wire has a constant high ductility that is independent of reduction over a wide range; (ii) it exhibits a superior combination of strength and ductility; (iii) it anneals very readily and at a sharply defined temperature; (iv) die wear is reduced to a very low level (even after allowance has been made for the reduced output rate per die) and (v) jointing when a supply reel is exhausted is simplified. Alternatively the machine could be run at a conventional (higher) speed to obtain drawn wire of conventional quality at a reduced cost.

The wire drawing machine in accordance with the invention is especially suitable for use in-line with an enamelling machine, preferably in accordance with application Ser. No. 303846 filed 6th Nov. 1972 by John Large and the present applicants, now U.S. Pat. No. 3,842,643.

The invention will be further described, by way of example, with reference to the accompanying drawings in which FIG. 1 is a partly-diagrammatic cut-away front view of an 18-line 8-stage wire drawing machine in accordance with the invention;

FIGS. 5 and 6 are cut-away end views of the machine shown in FIG. 4;

FIG. 7 is an enlarged detail of part of FIG. 5; and

FIG. 8 is a plan of the part of the apparatus shown in FIG. 7.

Figure 1:
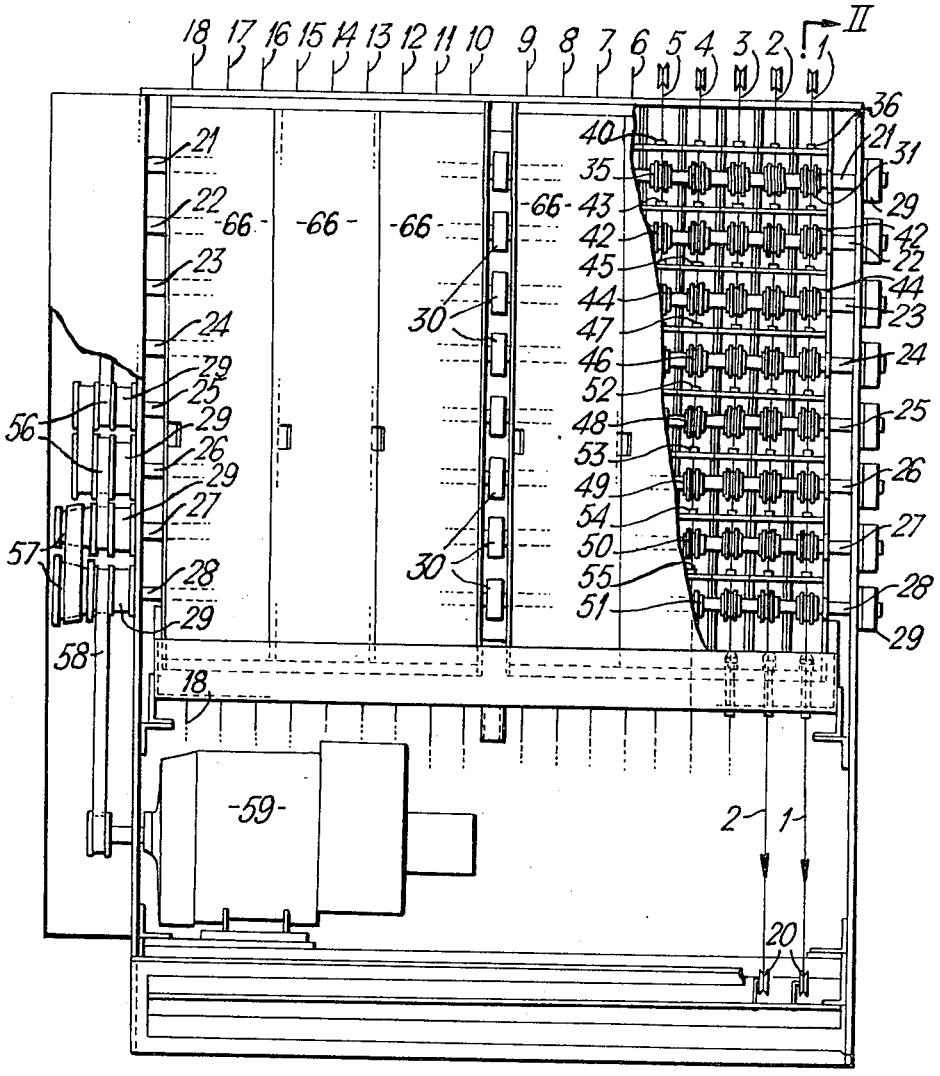
Figure 2:
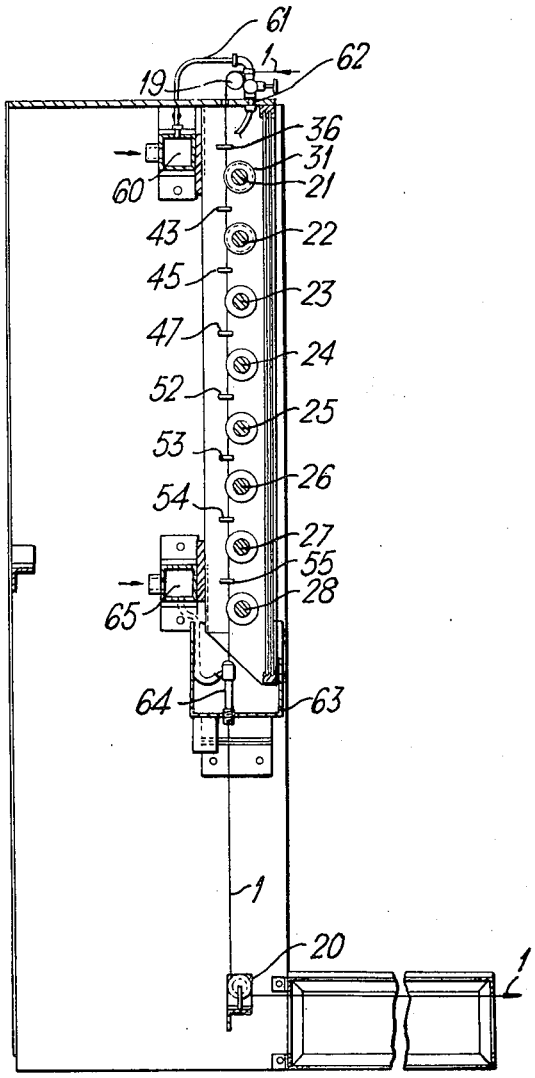
FIG. 2 is a cross-section on the line II—II in FIG. 1.
Figure 3:
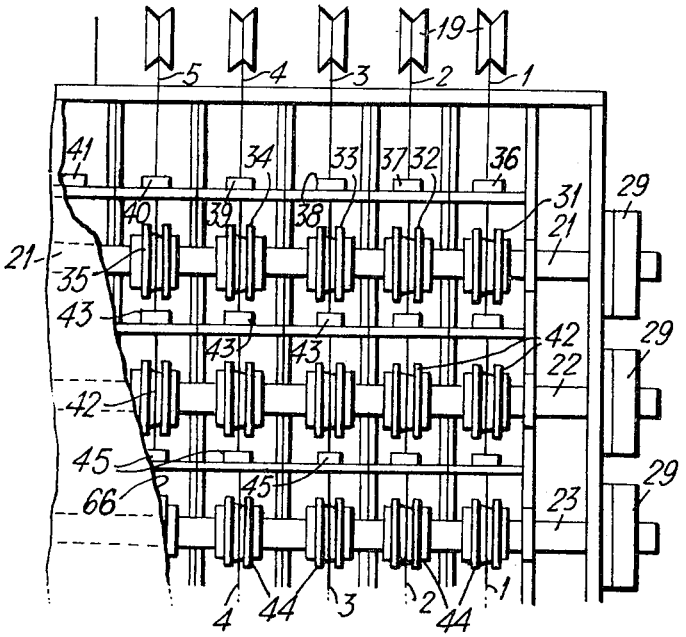
FIG. 3 is an enlargement of a portion of FIG. 1 showing additional reference numbers.
Figure 5:
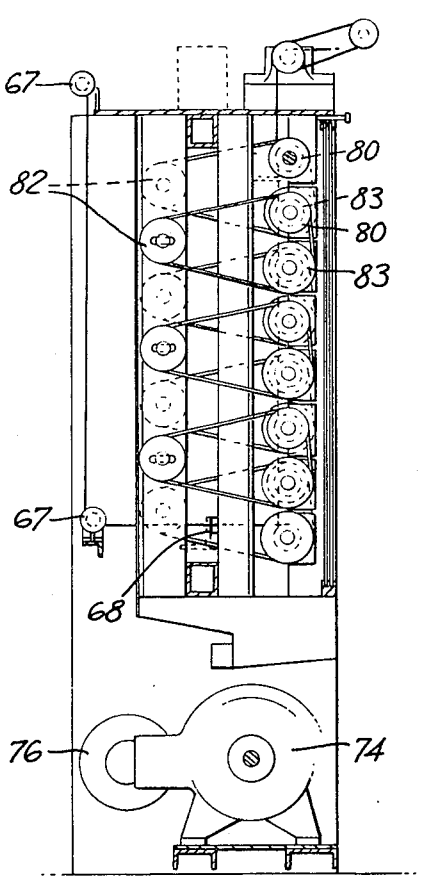

In the machine shown in FIGS. 1–3, eighteen wires 1–18 taken from supply packages (not shown) in any convenient manner enter over pulleys 19 at the top of the machine, travel generally downwards through the machine and emerge over pulleys 20 at the bottom of the machine, from which they may pass to a take-up mechanism or to in-line processing apparatus, especially enamelling or annealing apparatus.

The machine includes eight drive shafts 21–28 which are horizontal, parallel and vertically aligned. Each of these drive shafts is supported by three bearings, one bearing 29 at each end thereof and the third bearing 30 at the mid-point of the shaft (and between wires 9 and 10).

Rigidly mounted on and driven by the shaft 21 are 18 capstans 31, 32, 33, 34, 35 . . . (FIG. 3) which are the capstans for the first drawing stage: capstan 31 draws wire 1 through its first die 36, and similarly the other capstans 32–35 . . . on shaft 21 draw respective wires 2–18 through their first dies 36–41 . . . .

Similarly the second shaft 22 bears a series of capstans 42 for drawing the respective wires through respective 2nd-stage drawing dies 43, and so on for 3rd stage capstans 44 and dies 45; 4th stage capstans 46 and dies 47 (FIG. 1); and 5th–8th stage capstans 48–51 and dies 52–55 respectively.

The capstans are all identical; they may for example be of the kind in which a ceramic ring forms the working surface. Preferably the working surfaces of the capstans are slightly tapered.

To provide the necessary increase in the peripheral speeds of the capstans as drawing progresses the shafts 21–28 are coupled together by gearing, diagrammatically represented in FIG. 1 by drive belts 56, arranged to give the shafts correctly graded angular velocities.

The gearing between shafts 27 and 28 is of variable ratio, for example using tapered or stepped pulleys 57, to allow minor adjustments of output wire size by changing the 8th-stage dies 55 whilst the remainder are unaltered and the drive ratio of all the other stages is pre-set by selecting appropriate sizes for the wheels engaged by the belts 56.

The shaft 28 for the eighth drawing stage is driven through a main drive belt 58 from a motor 59, which thus drives all the capstans throughout the machine.

Referring now to FIG. 2, lubricant from a manifold 60 is fed via piping 61 and a valve 62 to the first die 36 of the first wire line; lubricant is similarly fed to all the other dies, but the associated plumbing has been omitted from the drawings to avoid obscuring more important features of the machine. Used lubricant is collected in a trough 63 below the last capstan, and air (or steam) jets 64 supplied from an air (or steam) manifold 65 are preferably used to strip residual lubricant from the drawn wires.

Since, especially if run at a relatively low wire speed, the machine can be expected to run for long periods without attention, it is practicable to enclose at least the part of the machine where the wires are set with lubricant, using for instance sliding glass doors 66, in order to maintain a high level of cleanliness.

The machine shown in FIGS. 4–8 incorporates a number of significant improvements.

Firstly, after being guided downwards by pulleys 67 (FIG. 5), each wire passes horizontally through its first die 68 and then upwards through dies 69 . . . 69, 70. This has the advantages that it is easier to keep foreign materials out of the die entrances and that the wire may emerge from its final die 70 in a sufficiently dry state to avoid the need for air or stream stripping. Each final die 70 is positioned directly under the top plate 71 and the final shaft 72 with its capstans 73 is placed above the top plate.

Figure 4:
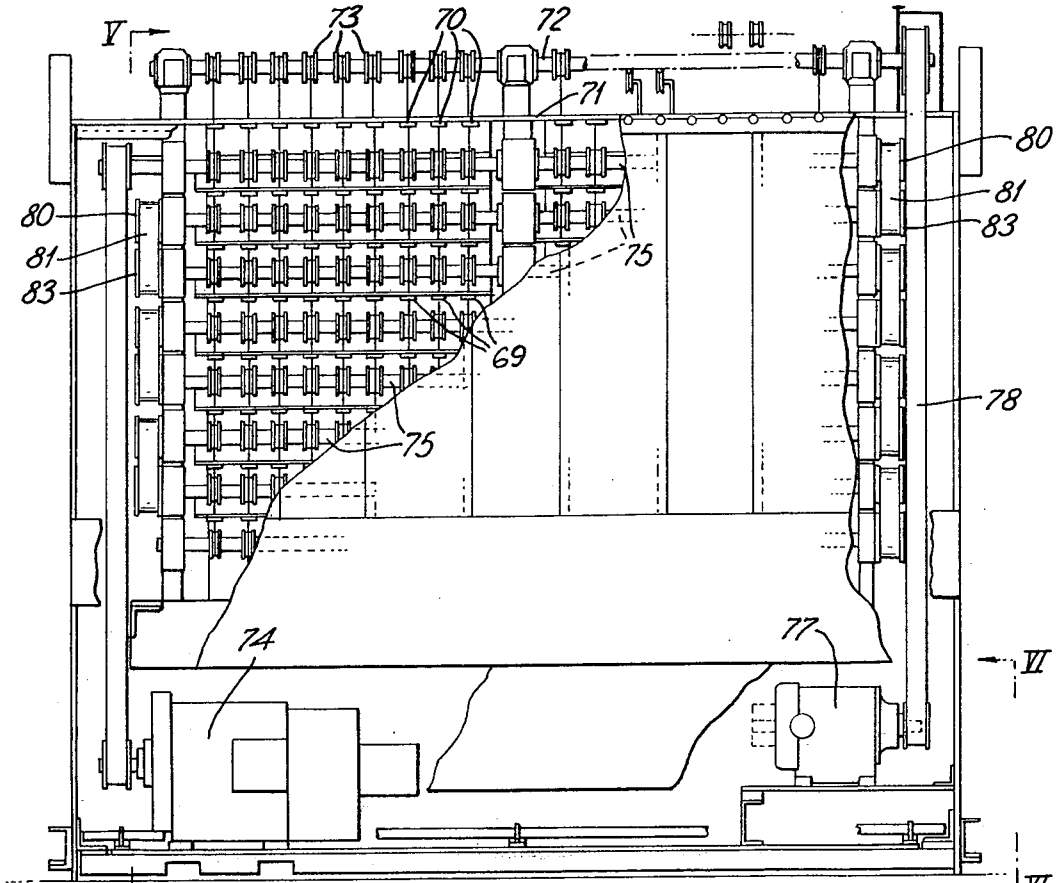
FIG. 4 is a view, similar to FIG. 1, of an alternative and preferred form of machine.

Secondly, this final shaft 73 is not driven from the main motor 74 that drives the other shafts 75 (as described below) but has a separate motor 76 driving it through a variable-speed gear box 77 (FIG. 6) and belt 78 (FIG. 4). In one particular size of machine, the main motor 74 is a variable-speed D.C. motor with thyristor control rated 10 h.p. at 1500 r.p.m.; the separate motor 76 is a constant-speed motor rated 1½ h.p. at its design speed of 1420 r.p.m., and the variable-speed gear box is the Carter Hydraulic variable-speed box reference F.12 sold by Reynolds Ltd. of Carter Hydraulic Works, Thornbury, Bradford, Yorkshire BD3 8HG, England. This modification simplifies control of the last capstan-shaft.

Thirdly, to facilitate changes of capstan elongation, the main drive mechanism has been divided between the two ends of the shafts. Thus the main drive is taken to the 8th shaft by a "timing" belt 79 at the left-hand side of the machine as seen in FIG. 4. A toothed drive wheel 80 at the right-hand end of the 8th shaft drives the 7th shaft through another timing belt 81 (tensioned by an adjustable idler wheel 82) and a driven wheel 83. The 6th shaft, and each of the other even-numbered shafts, is driven similarly at the left-hand end of the machine, whilst the odd-numbered shafts are driven similarly at the right-hand side of the machine.

To alter the capstan elongation of any particular stage, the relevant drive wheel 80 is exchanged for one having a different number of teeth and the associated belt 81 is re-tensioned by sliding the mounting 84 for the idler wheel 82 in the slot 85 in which it is mounted. For example, if the driven wheel 83 has 30 teeth, drive wheels 80 having 27, 26, 25 and 24 teeth may be used to obtain respective capstan elongations of approximately 11%, 15%, 20% and 25%.

It will be appreciated that the pitch of the toothed wheels 80, 83 (i.e. the circumferential distance between the teeth) must be substantially the same and must correspond to the teeth of the timing belt 81.

What we claim in our invention is:

1. In a machine for reducing the cross-section of at least four wires by drawing each of them through a respective series of dies of decreasing diameter defining a number of drawing stages which is the same for all the wires and is at least four, said machine comprising a corresponding series of individual capstans for drawing each said wire through its said series of dies and a plurality of drive shafts, one for each drawing stage, each said shaft supporting at spaced positions along its length and driving the capstans for said respective drawing stage, the improvement which comprises providing adjacent at least one of the ends of all said shafts interchangeable drive means coupling adjacent ones of said shafts and in which said interchangeable drive means of at least one adjcent pair of shafts comprises a toothed pulley mounted on each shaft of said pair, a timing belt engaging said toothed pulleys, and adjustable tensioning means for said belt, at least one said toothed pulley being exchangeable for a toothed pulley having a different number of teeth of the same pitch within the range of said tensioning means for the belt.

2. A machine as claimed in claim 1 wherein said interchangeable drive means couples each said shaft at one of its ends to only one adjacent said shaft and, in the case of a said shaft that is adjacent to two other said shafts, couples it at its opposite end to the other of said adjacent shafts.

3. In a machine for reducing the cross-section of at least four wires by drawing each of them through a respective series of dies of decreasing diameter defining a number of drawing stages which is the same for all the wires and is at least four, said machine comprising a corresponding series of individual capstans for drawing each said wire through its said series of dies and a plurality of drive shafts, one for each drawing stage, each said shaft supporting at spaced positions along its length and driving the capstans for said respective drawing stage, the improvement which comprises supporting each said shaft by bearings located between each end of the shaft and those said capstans mounted thereon and driving the shafts by driving means located to that side of each of said bearings remoted from said capstans mounted thereon and coupling each said shaft at one of its ends to only one adjacent said shaft and, in the case of a said shaft that is adjacent to two other said shafts, coupling it at its opposite end to the other of said adjacent shafts, said drive means of at least one adjcent pair of shafts comprising a toothed pulley mounted on each shaft of said pair, a timing belt engaging said toothed pulleys, and adjustable tensioning means for said belt, at least one said toothed pulley being exchangeable for a toothed pulley having a different number of teeth of the same pitch within the range of said tensioning means for the belt.

* * * * *